United States Patent [19]

Ames

[11] Patent Number: 4,953,860

[45] Date of Patent: Sep. 4, 1990

[54] POOL CUE BRIDGE

[76] Inventor: Marc L. Ames, 539 Lyme Rock Rd., Bridgewater, N.J. 08807

[21] Appl. No.: 318,740

[22] Filed: Mar. 3, 1989

[51] Int. Cl.[5] ..... A63B 71/00

[52] U.S. Cl. ..... 273/23

[58] Field of Search ..... 273/23

[56] References Cited

U.S. PATENT DOCUMENTS

| | | | |
|---|---|---|---|
| 304,216 | 8/1884 | McIntire | 273/23 |
| 453,797 | 6/1891 | Wicliffe | 273/23 |
| 690,617 | 1/1902 | Richland | 273/23 |
| 890,789 | 6/1908 | Nelson | 273/23 |
| 3,576,324 | 4/1971 | Lareau | 273/23 |
| 4,149,718 | 4/1979 | Russo | 273/23 |

FOREIGN PATENT DOCUMENTS

| | | | |
|---|---|---|---|
| 309768 | 4/1929 | United Kingdom | 273/23 |

*Primary Examiner*—Theatrice Brown
*Attorney, Agent, or Firm*—Robert J. Ferb

[57] ABSTRACT

This invention is comprised of an improved pool cue bridge made of transparent plastic rectangular in shape and having up to sixteen positions to support a cue stick. Support positions are disposed on three sides of the perimeter of the bridge and in addition the bridge contains internal openings preferably in the shape of a cross and a heart which provides up to nine additional support positions.

7 Claims, 2 Drawing Sheets

POOL CUE BRIDGE

BACKGROUND OF THE INVENTION

The game of pool, whether played with a normal compliment of fifteen balls or nine balls, or any of the many variations of the basic game, frequently requires the use of a bridge to permit the players to make shots, when the cue ball is either out of reach, or is blocked in one fashion or another by other balls on the table. There are a number of conventional pool cue bridges presently available. The most common pool cue bridge provides for five positions for supporting the pool cue to facilitate making various shots. These conventional bridges are typically metal or an opaque plastic material, and while they have five support positions, due to the normal symmetry of their construction, only three positions with regard to the height of the support position compared to the surface of the pool table are provided by these conventional bridges. In order to compensate for this limited number of positions, players move the bridge closer or further away from the cue ball to permit the appropriate point of impact between the tip of the cue stick and the cue ball. When the bridge is located at a greater distance from the cue ball, inaccuracies in striking the cue ball with the cue occur because of the long extension of the cue stick over the bridge in order to reach the cue ball. This limitation in the number of positions on conventional bridges contribute to a lack of precision in aiming the application of "english" or spin and missed shots. In addition, the vast majority of conventional bridges, because of their opaque construction, tend to obscure the player's view of the area between the player and the balls, and interferes with what would otherwise be a more desirable unobstructed view of the cue ball, and the ball at which the cue ball is directed. This factor further complicates an already difficult shot which requires the use of the bridge in the first place.

SUMMARY OF THE INVENTION

The present invention, an improved pool cue bridge has the general objective of providing for more support positions than conventional bridges. In addition, it is made of such a design and material as to provide minimum visual interference with the sight of the player making use of this invention.

Accordingly, it is an object of this invention to provide a bridge which is made of a rugged and durable transparent material.

It is a further object of this invention, to provide a support bridge with as many as sixteen separate distinct support positions or cue rests.

It is a further object of this invention, to provide a support bridge which can be placed more frequently, with greater accuracy, at a consistent distance from the cue ball to minimize the long reaches between the bridge and the cue ball.

It is a further object of this invention, to provide a bridge which permits, in a greater variety of situations, a level or close to level alignment of the cue, in relation to the cue ball.

It is a further object of this invention, to provide a bridge which, because of its many cuing positions, assists the player in striking the cue ball dead center, as well as above or below the center line. It further permits more precise positioning, at any height, to strike the cue ball to the left or right of center.

It is also an object of this invention, to provide a support bridge that is somewhat larger and more stable than conventional bridges thereby reducing the possibility of bridge movement as the cue is moved over it and generally reducing the possibility of miscuing or fouling during play. This larger size, which provides increased height, reduces the necessity for the use of multiple bridges to achieve height to reach over obstructing balls with the cue.

It is also an object of this invention to provide improved visibility and avoid miscues or inadvertent contact or "fouling" with the cue and the balls by reason of the bridge's transparency. This transparency also improves the player's ability to place the bridge more precisely on the table in close proximity to the balls without inadvertent contact.

It is also an object, to provide a relatively easy to manufacture and inexpensive improved bridge.

DESCRIPTION OF PREFERRED EMBODIMENTS

Figure 1:
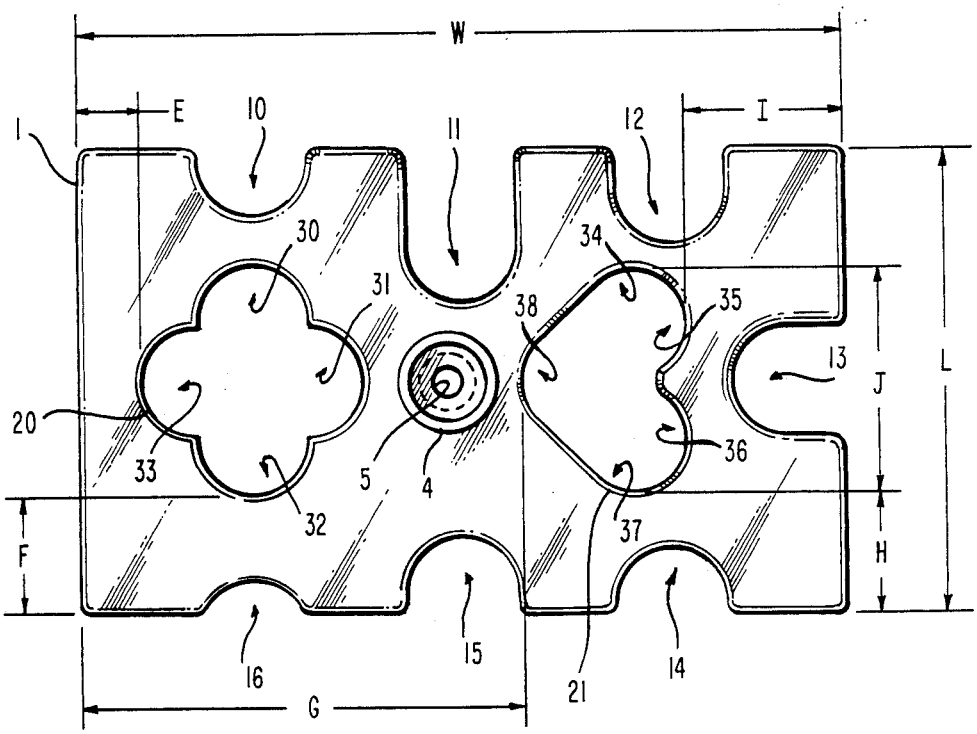
FIG. 1, is an end view of the improved pool cue bridge.

Referring to the improved pool cue bridge in FIG. 1, in the preferred embodiment for use with a standard ball two and one quarter inches in diameter, the length L is two and seven eighths inches and the width W is four and seven eighths inches. On the periphery of bridge 1 is a series of support points numbered 10, 11, 12, 13, 14, 15 and 16. The preferred dimensions of which are as follows; support position 10 having a depth of three eighths of an inch, support position 11 having a depth of fifteen sixteenths of an inch, support position 12 having a depth of five eighths of an inch, support position 13 having a depth of three quarters of an inch, support position 14 having a depth seven sixteenths of an inch, support position 15 having a depth of one half an inch and support position 16 having a depth of one quarter of an inch. A generally cross shaped opening 20 located on the horizontal centerline of bridge 1 and which provides for support positions 30, 31, 32 and 33, has major dimensions of one and one half inches between position 31 and position 33, and position 33 being located a distance E of five sixteenths of an inch from the edge of bridge 1. In opening 20, the dimension between position 30 and 32 being one and nine sixteenths inches, and position 32 being located a distance F of eleven sixteenths of an inch from the edge of bridge 1. A second generally heart shaped opening 21 also located on the horizontal centerline of bridge 1 provides for positions 34, 35, 36, 37 and 38. Position 38 being located a distance G from the edge of bridge 1 two and seven eighths inches. Positions 35 and 36 being located a distance I from the edge of bridge 1 of one inch. Position 37 being located a distance H from the edge of bridge 1 of three quarters of an inch. Position 34 being located a distance J of one and one half inches from position 37.

Figure 2:
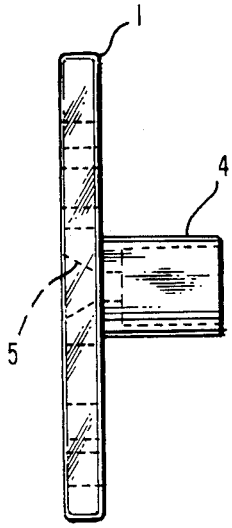
FIG. 2, is an edge view of the improved pool cue bridge.
Figure 4:
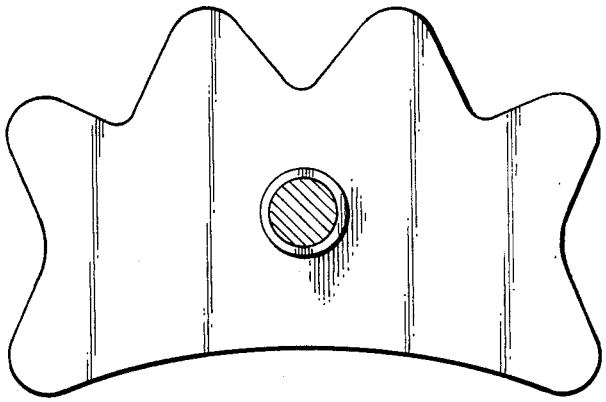
FIG. 4, is a conventional pool cue bridge with five support positions.
Figure 3:
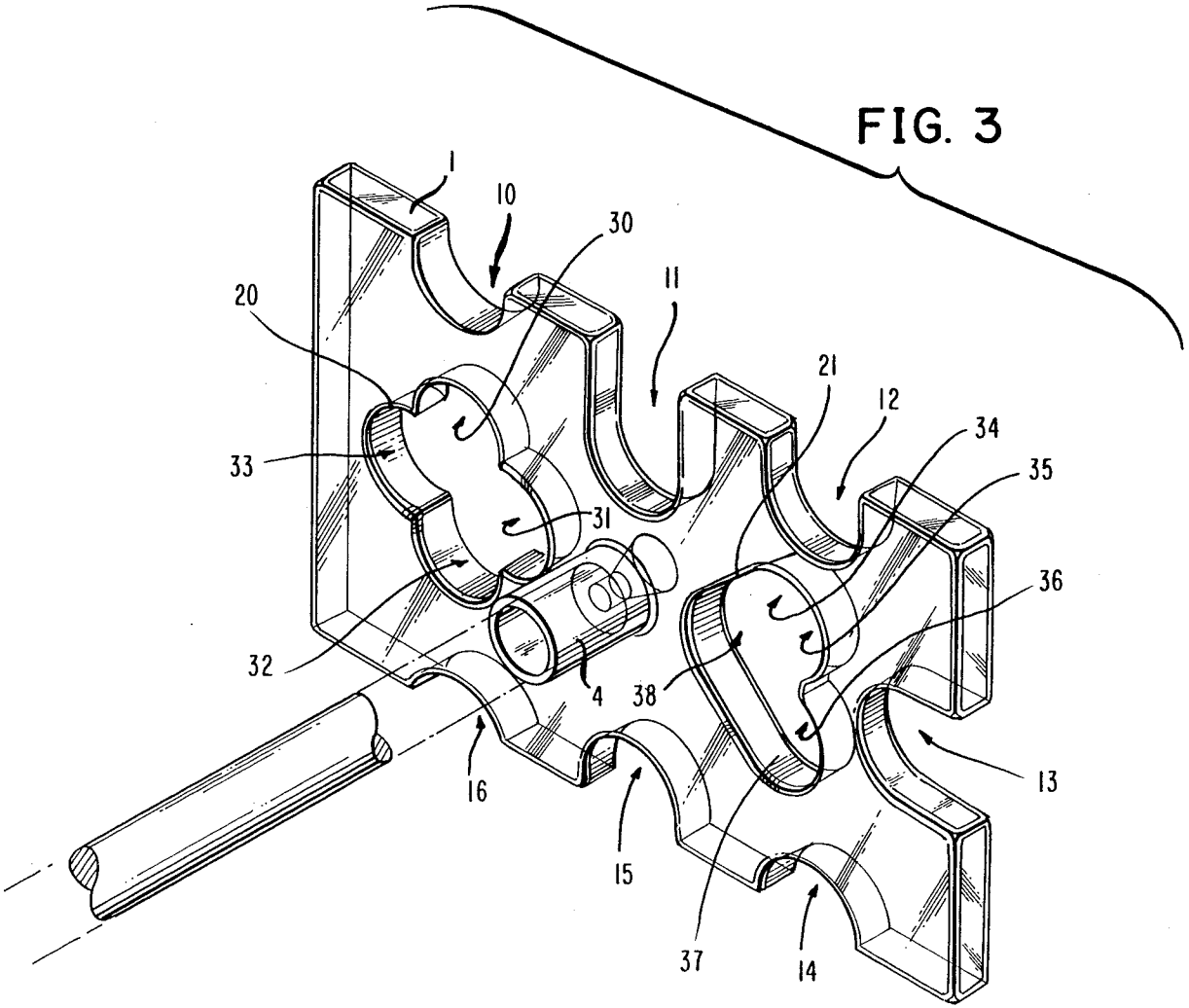
FIG. 3, is an isometric view of the bridge attached to a conventional bridge handle from the rear or the players side of the bridge.

In FIG. 2, stick support collar 4 is rigidly attached to bridge 1, and screw hole 5 permits the use of a screw, or similar fastening means to attach bridge handle 6 to the bridge 1. Bridge 1 is preferably made from a clear thermoplastic material which is transparent in its final molded form.

The improved bridge described herein has been shown and described as preferred for use with two and a quarter inch diameter balls. It is contemplated that with other side balls proportionally larger or smaller embodiments fall within the scope of this invention, and in addition, embodiments somewhat larger or smaller than the preferred embodiment are also contemplated for use with two and a quarter inch balls. In addition, it is within the contemplation of the invention, that the depth of the support positions might be varied somewhat and still be included within the scope of the invention. In addition, the dimensions and location of the internal openings might also be varied somewhat, and still are contemplated to be within the scope of the invention. It is understood that various modifications in construction and application may be made within the spirit and scope of the present invention. The invention, therefore, should be limited only by the appended claims.

I claim:

1. An improved pool cue bridge which is comprised of a rectangular shaped bridge having width and length sides containing seven cue support positions, three of which being disposed along each long side of said rectangular bridge, said bridge further containing at least one opening within the perimeter thereof, said opening being generally heart shaped and having at least one cue support position.

2. An improved pool cue bridge as described in claim 1, further containing two openings within the perimeter of said bridge, said at least one generally cross shaped opening in which are disposed four cue support positions and another opening being generally heart shaped in which are disposed five cue support positions.

3. An improved pool cue bridge as described in claim 2, which is formed from a transparent material.

4. An improved pool cue bridge as described in claim 3, the length of said bridge being approximately two and seven eighths inches and the width being approximately four and seven eighths inches, three of said support positions being located along one of said width sides, the first of said support positions having a depth of approximately three eighths of an inch, the second said support position having a depth of approximately fifteen sixteenths of an inch, the third said support position having a depth of approximately five eighths of an inch, a fourth support position being located along one of the said length sides of said bridge having a depth of approximately three quarters of an inch, the fifth, sixth and seventh support position being located along the other width side of said bridge, said fifth support position having a depth of approximately seven sixteenths of an inch, said sixth support position having a depth of approximately one half an inch and said seventh support position having a depth of approximately one quarter of an inch, said bridge also containing a first generally cross shaped opening located on the width centerline of said bridge, said cross shape opening containing additional support positions eight, nine, ten and eleven, said support position eight being located approximately one and one half inches opposite support position ten and said position ten being located a distance of approximately eleven sixteenths of an inch from the the other width side of said bridge, said position nine being located approximately one and nine sixteenths inches opposite said position eleven, and said position eleven being located a distance of approximately five sixteenths of an inch from the other length side of said bridge, said bridge containing a second generally heart shaped opening also located on the width centerline of said bridge, said heart shaped containing additional support positions twelve, thirteen, fourteen, fifteen and sixteen, said position sixteen being located approximately two and seven eighths inches from the other length side of said bridge, said positions thirteen and fourteen being located approximately one inch from said one length side of said bridge, said position fifteen being located a distance of approximately of three quarters of an inch from the other width side of said bridge and position twelve being located located a distance approximately one and one half inches opposite from position fifteen.

5. An improved pool cue bridge comprised of a rectangular shaped bridge containing seven cue support positions, three of which are disposed along each width side of said bridge, said bridge further containing at least one opening within the perimeter thereof, said opening being generally heart shaped and having at least one cue support position.

6. An improved pool cue bridge as described in claim 5, further containing two openings within the perimeter of said bridge, said at least one generally heart shaped opening in which there are disposed five cue support positions and another opening having a generally cross shape in which are disposed four cue support positions.

7. An improved pool cue bridge as described in claim 6 the length of said bridge being approximately two and seven eights inches and the width being approximately four and seven eights inches, three of said seven support positions being located along one of said width sides the first of said support positions having a depth of approximately three eights of an inch, the second said support positions having a depth of approximately fifteen sixteenths of an inch, the third said support position having a depth of approximately five eights of an inch, a fourth support position being located along one of said length sides of bridge having a depth of approximately three quarters of an inch, the fifth, sixth and seventh support position being located along the other width side of said bridge, said fifth support position having a depth of approximately seven sixteenths of an inch, said sixth support position having a depth of approximately one half an inch and said seventh support position having a depth of approximately one quarter of an inch, said bridge also containing a first generally cross shaped opening located on the width centerline of said bridge, said cross shape opening containing additional support positions eight, nine, ten and eleven, said support position eight being located approximately one and one half inches opposite support position ten and said position ten being located a distance of approximately eleven sixteenths of an inch from the other width side of said bridge, said position nine being located approximately one and nine sixteenths inches opposite said position eleven, and said position eleven being located a distance of approximately five sixteenths of an inch from the other length side of said bridge, said bridge containing a second generally heart shaped opening also located on the width centerline of said bridge, said heart shaped opening containing additional support positions twelve, thirteen, fourteen, fifteen and sixteen, said position sixteen being located approximately two and seven eights inches from the other length side of said bridge, said positions thirteen and fourteen being located approximately one inch from said one length side of said bridge, said position fifteen being located a distance of approximately of three quarters of an inch from the other width side of said bridge and position twelve being located located a distance approximately one and one half inches opposite from position fifteen.

* * * * *